United States Patent [19]

Kelmar

[11] 4,249,996

[45] Feb. 10, 1981

[54] ELECTRICALLY HEATED BY-PRODUCT COKE OVEN

[76] Inventor: John J. Kelmar, 2205 Cypress Dr., McKeesport, Pa. 15131

[21] Appl. No.: 47,876

[22] Filed: Jun. 12, 1979

[51] Int. Cl.[3] ..... C10B 5/00; C10B 19/00

[52] U.S. Cl. ..... 202/133; 13/7; 13/22; 13/33; 201/19; 202/248; 202/262

[58] Field of Search ..... 201/19; 202/93, 99, 202/108, 133, 137, 248, 262; 13/7, 22, 33

[56] References Cited

U.S. PATENT DOCUMENTS

| | | | |
|---|---|---|---|
| 672,694 | 4/1901 | Besemfelder | 13/7 |
| 763,366 | 6/1904 | Conley | 202/99 |
| 1,601,212 | 9/1926 | Henry | 201/19 X |
| 1,706,420 | 3/1926 | Trent | 201/19 X |
| 1,731,474 | 10/1929 | Naugle | 201/19 X |
| 1,802,892 | 4/1931 | Hansen | 13/22 |
| 1,993,756 | 3/1935 | Stevens | 201/19 |
| 3,284,317 | 11/1966 | Jahnig et al. | 210/19 X |
| 3,515,293 | 6/1970 | Cain | 202/262 X |

*Primary Examiner*—Frank W. Lutter
*Assistant Examiner*—Roger F. Phillips
*Attorney, Agent, or Firm*—Brown, Flick & Peckham

[57] ABSTRACT

The coking chamber of a by-product coke oven is formed by a refractory enclosure provided in its top with a charging opening and with an outlet for volatile by-products produced in the coking operation. Forming the bottom of the chamber near the bottom wall of the enclosure, but spaced above it, is a high-temperature resistant metal sole plate, beneath which are electric resistance elements for heating the plate directly in order to coke coal supported by the plate. Opposite sides of the lower part of the chamber may also be formed by electrically heated plates.

4 Claims, 3 Drawing Figures

ELECTRICALLY HEATED BY-PRODUCT COKE OVEN

Unlike the beehive coking process, in which all of the volatiles are burned to make the coke, in the by-product coking process the gases and chemicals that are produced are recovered after about 40% of the coke oven gas has been consumed for heating the ovens. In the past, the heat for the ovens, however produced, has had to be conducted through the refractory walls of the ovens. Although in modern coke ovens the flue temperature of the heating gas is in the range of 2600° to 2700° F., the skin temperature at the face of the coal is reduced to 1900° F., due to the fact that the heat transfer rate through the refractory walls does not exceed 4000 BTUs per square foot per hour of wall area.

The coking time in a beehive oven, where the coal charge is about two feet deep, is about twenty-four hours. For a coal charge forty-two inches deep, the coking time is about forty-eight hours. In a by-product oven the coking time is about one hour per inch depth of coal, whereby it again requires about twenty-four hours to coke a charge of coal that is two feet deep.

It is among the objects of this invention to provide a high temperature by-product coke oven in which coking time is reduced materially as compared with present practice, in which none of the coke oven gas needs to be used for heating the oven, in which heat regenerative chambers are eliminated, and which is suitable for coking low volatile coal.

The preferred embodiment of the invention is illustrated in the accompanying drawings, in which FIG. 1 is a plan view;

Figure 1:
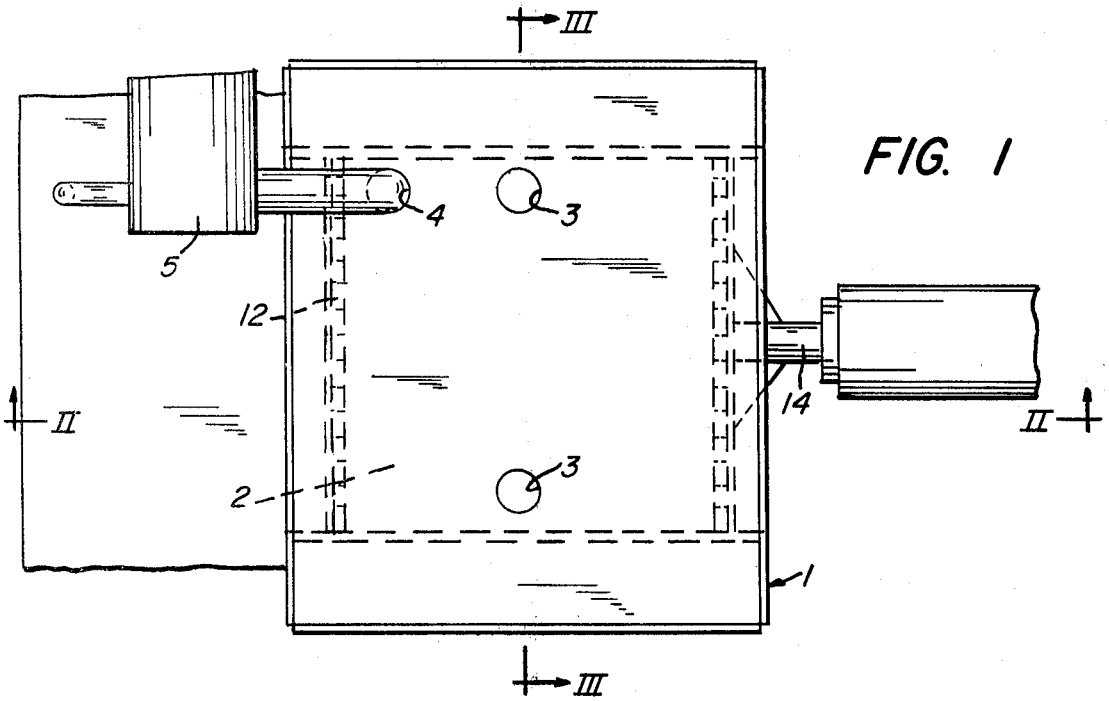
Figure 2:
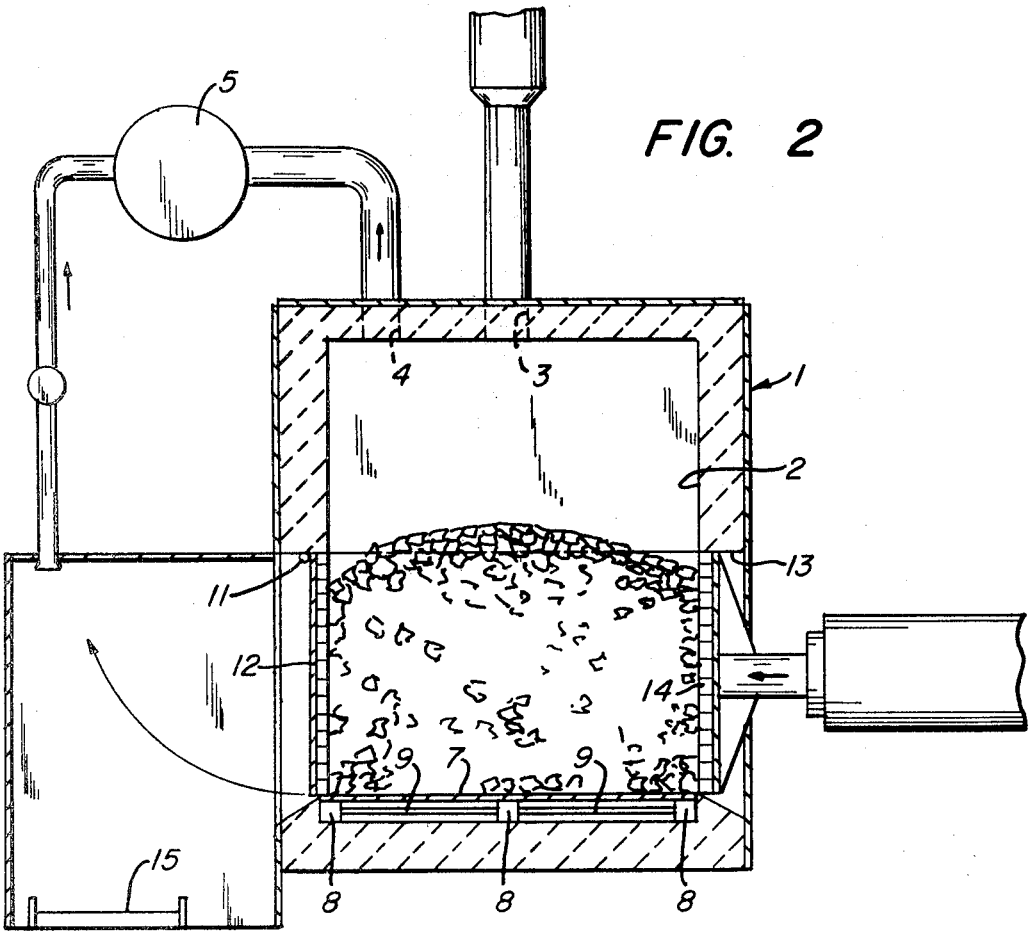
FIG. 2 is a vertical section taken on the line II—II of FIG. 1.

Referring to the drawings, a by-product coke oven is constructed from walls of suitable fire brick forming an enclosure 1 around a coking chamber 2 that measure, for example, eight feet long and six feet wide. The top wall of the chamber is provided with coal-charging openings 3 that are closed except during charging. The top of the chamber also is provided with an outlet 4 for volatiles produced in the coking operation, which are carried away by a pipe 5 for further processing.

This coke oven is not provided with heating flues in its walls, nor with any other means for heating the refractory walls. On the contrary, it is a feature of this invention that the bottom of the coking chamber is formed by a metal sole plate 7 suitably supported a short distance above the bottom wall of the enclosure by refractory blocks 8. This plate is made of a high temperature alloy that is immune to reaction with sulfur and carbon compounds and that will withstand the high temperature to which it is heated. Directly below the plate in the space between it and the bottom wall of the enclosure there are electrical resistance elements 9 for directly heating the plate to a high temperature, such as 2100° F., in order to rapidly coke a charge of coal supported by the plate. These resistance elements are electrically connected in any suitable manner to a source of electric power (not shown). The resistance elements are sealed in the space below the sole plate to avoid gases that might short circuit the heating system.

The opposite ends of the coking chamber are provided with openings directly above the sole plate. One of these openings 11 normally is closed by a suitable door, preferably an outwardly swinging fire brick-lined door 12. The opposite opening 13 normally is closed by the front end of a pusher ram 14, which can be operated to push the coke out of the oven through doorway 11 and onto a closed hood ventilated conveyor 15 for carrying it away from the oven for further processing. Door 12 automatically opens when pusher ram 14 starts to move toward it.

With this invention, the necessity for conducting heat through the refractory walls of the coking chamber in order to heat the chamber is avoided. The electrically heated sole plate 7 forming the bottom of the chamber allows the coking time to be reduced materially, because electric heating allows the metal plate to be heated directly to a high temperature. The heat transfer through the plate is about 10,000 BTUs per square foot per hour, so the temperature inside the coking chamber can be several hundred degrees higher than when refractory walls have to conduct heat from flues to the coking chamber. For example, with a coal charge two feet deep, the coking time is approximately two hours as compared to a coking time of about twenty-four hours for the same depth of coal in a conventional by-product oven, and yet the energy consumed for electric heating is only about 20% of the total heat generated.

Another advantage is that, whereas in a conventional oven the width of the coking chamber must be quite narrow in order for the heat from the side walls to penetrate the coal between them, with the present invention the heat is supplied from beneath the charge and uniformally over its entire lower surface, so the width of the charge is not restricted and therefore can be made much greater by making the width of the coking chamber as great as the length of the chamber, or even greater. This results in a material reduction in the cost of constructing coke ovens for a predetermined overall capacity. It also has the big advantage that since the charge can be spread out over a large area the height of the charge can be reduced and there is ample space for expansion of low volatile coals, which therefore do not need to be mixed with high volatile coals to avoid damage to the oven.

Figure 3:
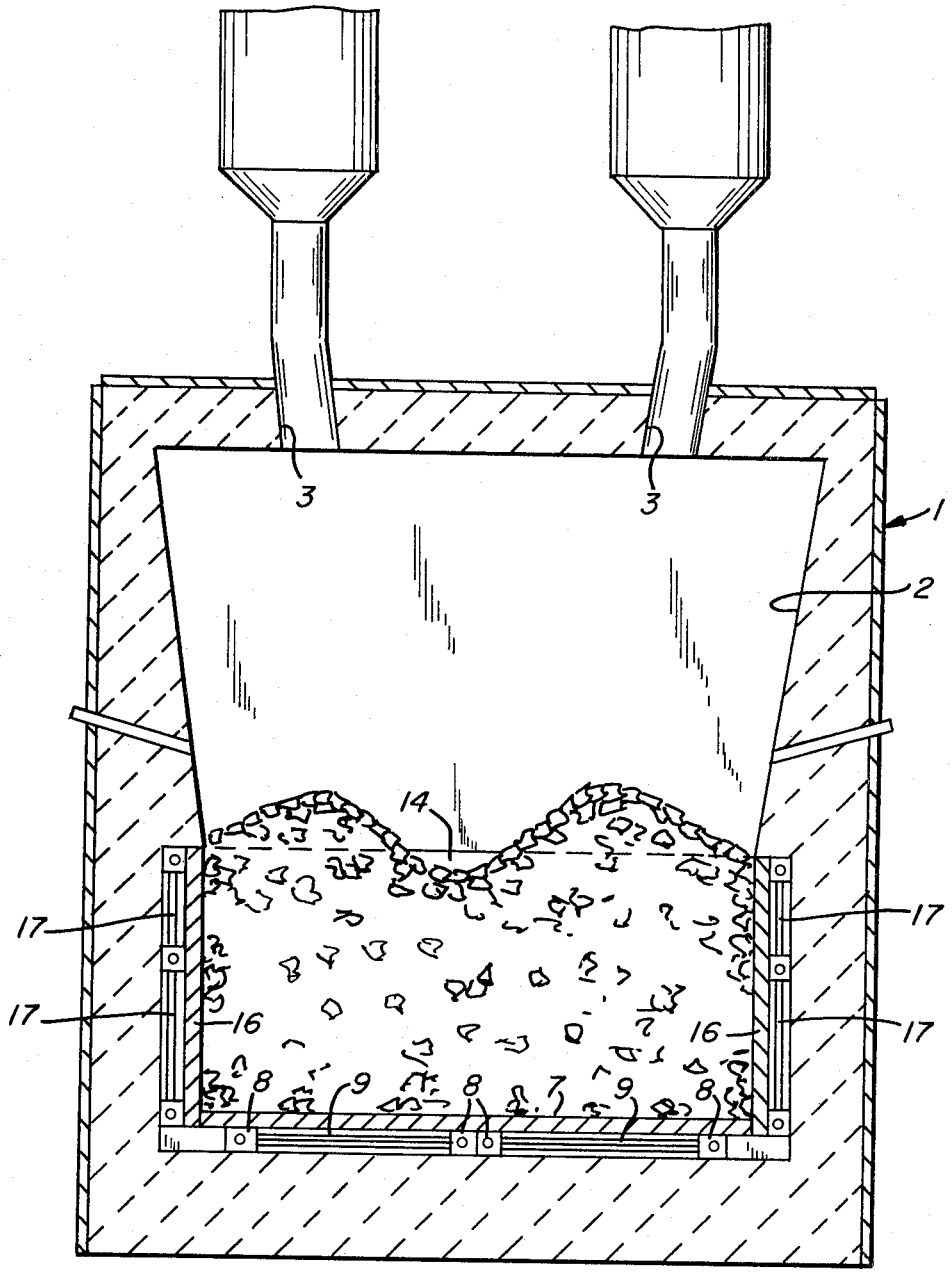
FIG. 3 is an enlarged vertical section taken on the line III—III of FIG. 1.

For coking deeper beds of coal than can be coked efficiently with only an electrically heated sole plate, electrically heated side plates can be added to form the lower part of two opposite sides of the coking chamber. These upright side plates 16, shown in FIG. 3, are mounted in recesses in the two sides of the chamber between the pusher and the door. They are spaced from the refractory walls behind them, and electrical resistance elements 17 are sealed in the space between each plate and the adjacent wall. These directly heated plates help the sole plate to heat the coal and convert it into coke.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A high temperature by-product coke oven comprising a refractory enclosure having walls forming a coking chamber provided at its top with a normally closed coal-charging opening and with an outlet for volatile by-products produced in a coking operation, a high-temperature resistant metal sole plate forming the bottom of said chamber near the bottom wall of said enclosure but spaced therefrom, and electrical resistance elements sealed in the space between said plate and the bottom wall of the enclosure for heating the plate directly to coke coal supported by the plate, said enclosure having normally closed openings at opposite ends of said chamber directly above said plate adapted to be opened to permit coke to be pushed out of the oven.

2. A high temperature by-product coke oven according to claim 1, including upright metal plates forming two opposite sides of the lower part of said coking chamber between said normally closed openings, each upright plate being spaced from the refractory side wall behind it, and electrical resistance elements sealed in the spaces between said upright plates and the adjacent refractory walls.

3. A high temperature by-product coke oven according to claim 2, in said sole plate and upright plates are an alloy immune to reaction with sulfur and carbon compounds.

4. A high temperature by-product coke oven according to claim 1, including a pusher ram having a front end normally closing one of said end openings of said chamber but slidable across said sole plate toward said other end opening to push coke out of the oven.

* * * * *